US007097482B1

(12) United States Patent
Little et al.

(10) Patent No.: US 7,097,482 B1
(45) Date of Patent: Aug. 29, 2006

(54) ELECTRICAL CONNECTOR WITH PIVOT PORTION

(75) Inventors: Terrance F. Little, York, PA (US); Tod M. Harlan, Mechanicsburg, PA (US); Joanne E. Shipe, Harrisburg, PA (US); Brian J. Gillespie, Harrisburg, PA (US); Robert W. Brown, Harrisburg, PA (US); Charles E. Kreutzberger, Akson, PA (US); Kevin E. Walker, Hershey, PA (US)

(73) Assignee: Hon Hai Precision Ind. Co., Ltd.

( * ) Notice: Subject to any disclaimer, the term of this patent is extended or adjusted under 35 U.S.C. 154(b) by 0 days.

(21) Appl. No.: 11/246,753

(22) Filed: Oct. 6, 2005

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS 5,458,506 A 10/1995 Yamaguchi et al.
5,785,549 A * 7/1998 Takayasu ..... 439/495
5,904,586 A 5/1999 Takayasu

* cited by examiner

*Primary Examiner*—Tho D. Ta
(74) *Attorney, Agent, or Firm*—Wei Te Chung

(57) ABSTRACT

An electrical connector (1) adapted for connecting a flexible board comprises an insulated housing (2) defining a number of retaining channels, a number of first and second contacts (3, 4) and a pressing member (5). Each first contact has a pivot portion extending in a longitudinal direction and functioning as pivot point for actuation of the pressing member. The pressing member has a number of passageways for receiving corresponding pivot portions. After the pivot portions are fully received in corresponding passageways, the second contacts are assembled in the retaining channels. The first contacts cooperate with the second contact to secure the pressing member in the longitudinal direction.

15 Claims, 11 Drawing Sheets

ELECTRICAL CONNECTOR WITH PIVOT PORTION

BACKGROUND OF THE INVENTION

1. Field of the Invention

The present invention is generally related to the art of electrical connectors for electrically connecting with a flexible board such as a flexible printed circuit or a flexible flat cable.

2. Description of Related Art

U.S. Pat. No. 5,904,586 (named the '586 patent for simplification) discloses a flexible board electrical connector, which comprises an insulated housing having an opening and a pair of projecting arms, a plurality of contacts having contact beams disposed in the opening and a pressing member attached to the housing for actuation between a closed position where it is close to the contacts and an open position where it is apart from the closed position. The contacts are made of substantially flat conductive sheet so as to provide pivot portions having arcuate tips with their axes extending in a direction of thickness of the conductive sheet. The pressing member has a plurality of compartments for accommodating the pivot portions, a pressing edge for depressing a flexible printed circuit against the contacts, and a bearing face engaging the pivot portions when the pressing member is turned downwardly to the closed position.

The '586 patent discloses other embodiments of the pivot portions. Referring to FIG. 6 of the '586 patent, the pivot portion is folded from the metal sheet in a U-shaped form, that is, the pivot portion is folded back from the upper beam of the contact. In the above embodiments, the pivot portions are received in the compartments each having a longitudinal wall and a later wall. When the pressing member is turned downwardly from the open position to the closed position, a flexible printed circuit is depressed to tightly contact with the contacts. The lateral walls of the pressing member engage with the pivot portions so as to prevent the pressing member from being deformed and coming off from the pivot portion. However, when the pressing member suffers from an unexpected force, the longitudinal walls of the pressing member urge the pivot portions biasing away from their correct position because of their shape. Accordingly, an electrical connection between the contacts and the flexible board is insufficient and unstable.

Referring to FIGS. 8–10, the pivot portions have apertures or studs and the pressing member has compartments for accommodating the pivot portions. Especially, as clearly described in the specification, each stud of the pivot portion may be made by a press machine or bonding a circular sheet. However, once the contacts suffer from an unexpected larger normal force, they would produce distortion and induce the studs to easily break off the contacts.

SUMMARY OF THE INVENTION

Accordingly, an object of the present invention is to provide an electrical connector which can stably connect with a flexible board.

In order to achieve the object set forth, an electrical connector adapted for connecting a flexible board is provided. The connector comprises an insulated housing defining a plurality of retaining channels; a plurality of first and second contacts retained in the retaining channels alternatively with each other along a longitudinal direction, each of the first and second contact having a contact beam and a support beam opposite to the contact beam and having a bearing portion, each first contact further having a pivot portion extending in the longitudinal direction; a pressing member comprising a plurality of compartments for accommodating the bearing portions and a plurality of partition walls making the compartments separate from each other, each partition wall defining a passageway for receiving the pivot portion which serves as a pivot point for actuation of the pressing member. Each partition wall is confined between the bearing portions of the first contact and the bearing portions of the second contact for securing the pressing member in the longitudinal direction.

Other objects, advantages and novel features of the present invention will be drawn from the following detailed description of a preferred embodiment of the present invention with attached drawings, in which:

DETAILED DESCRIPTION OF THE INVENTION

Reference will now be made in detail to the preferred embodiment of the present invention.

Figure 1:
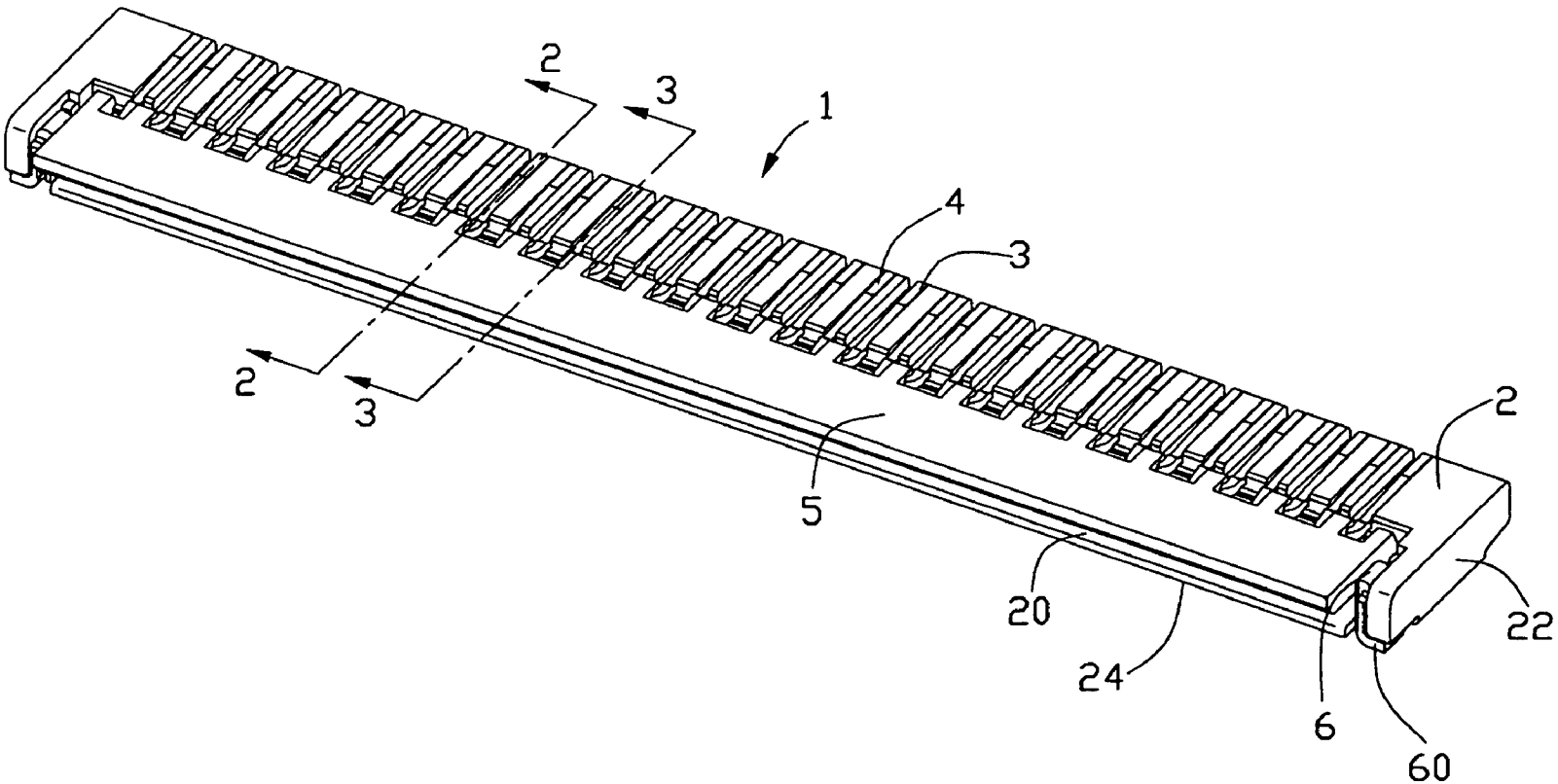
FIG. 1 is an assembled, perspective view of an electrical connector in accordance with the present invention.
Figure 2A:
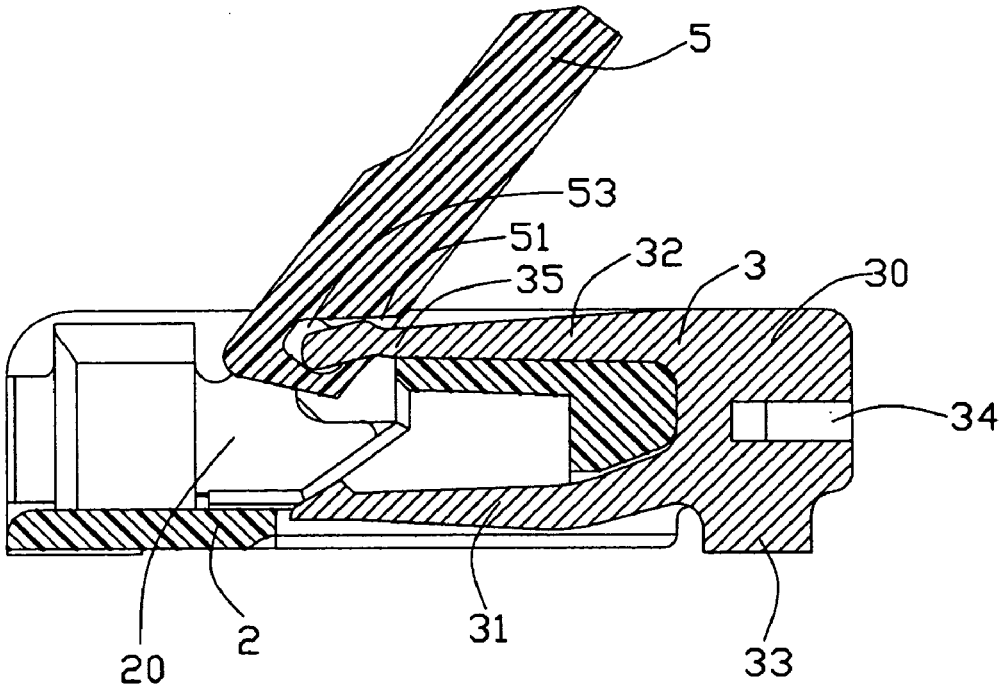
FIG. 2A is a cross-sectional view of the electrical connector taken along line 2—2 of FIG. 1, showing that a pressing member in an open position.
Figure 2B:
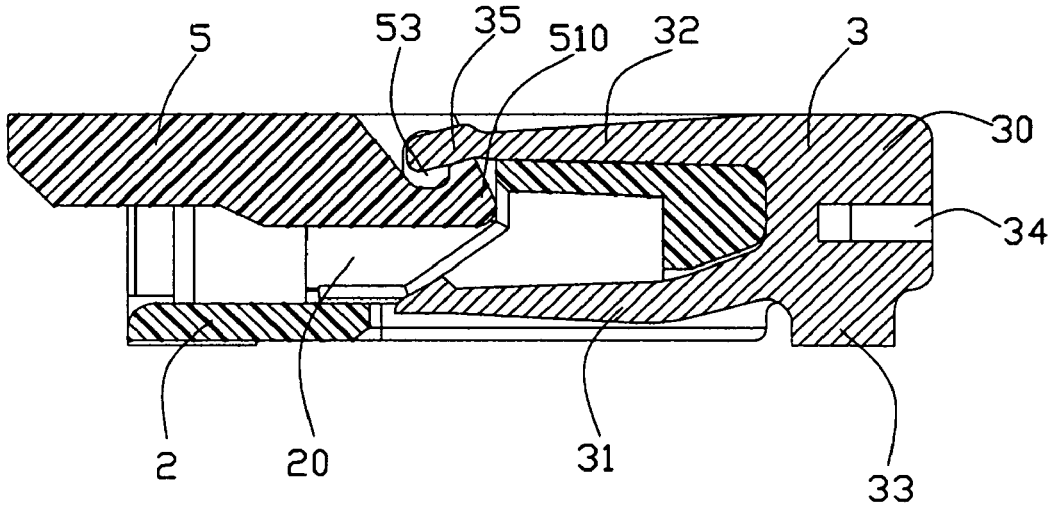
FIG. 2B is a similar view of FIG. 2A, but showing the pressing member is in a closed position.
Figure 3A:
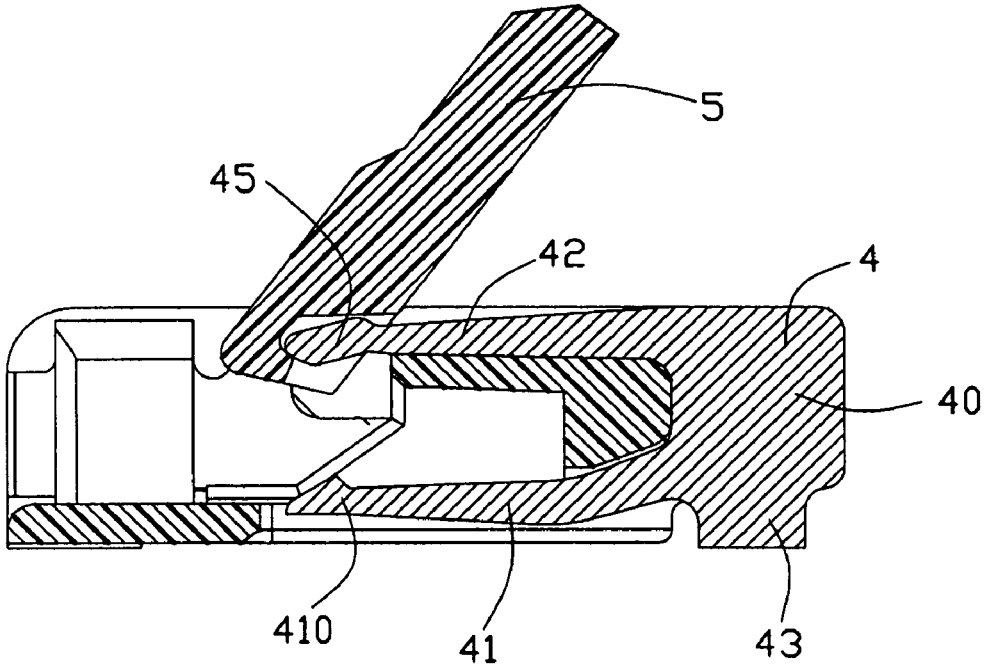
FIG. 3A is a cross-sectional view of the electrical connector taken along line 3—3 of FIG. 1, showing that the pressing member in the open position.
Figure 3B:
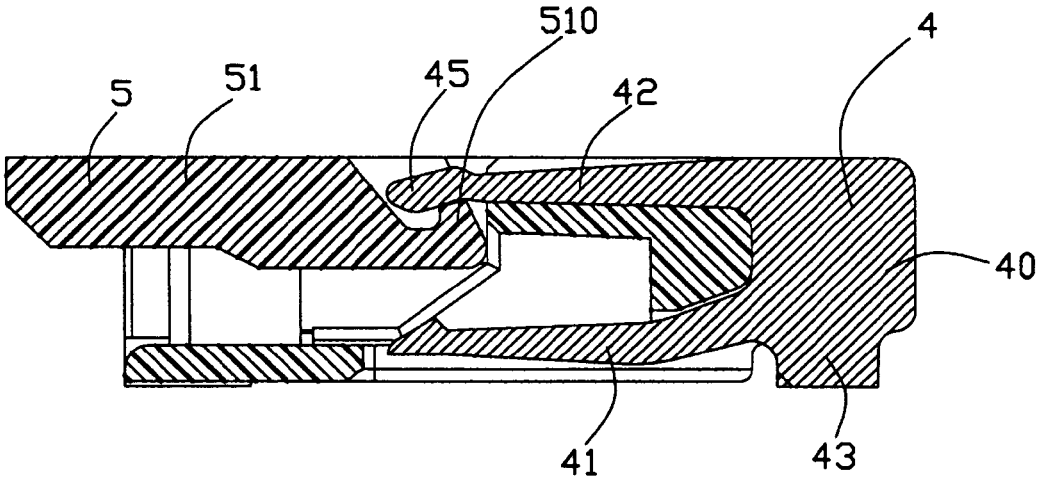
FIG. 3B is a similar view of FIG. 3A, but showing the pressing member is in the closed position.
Figure 4A:
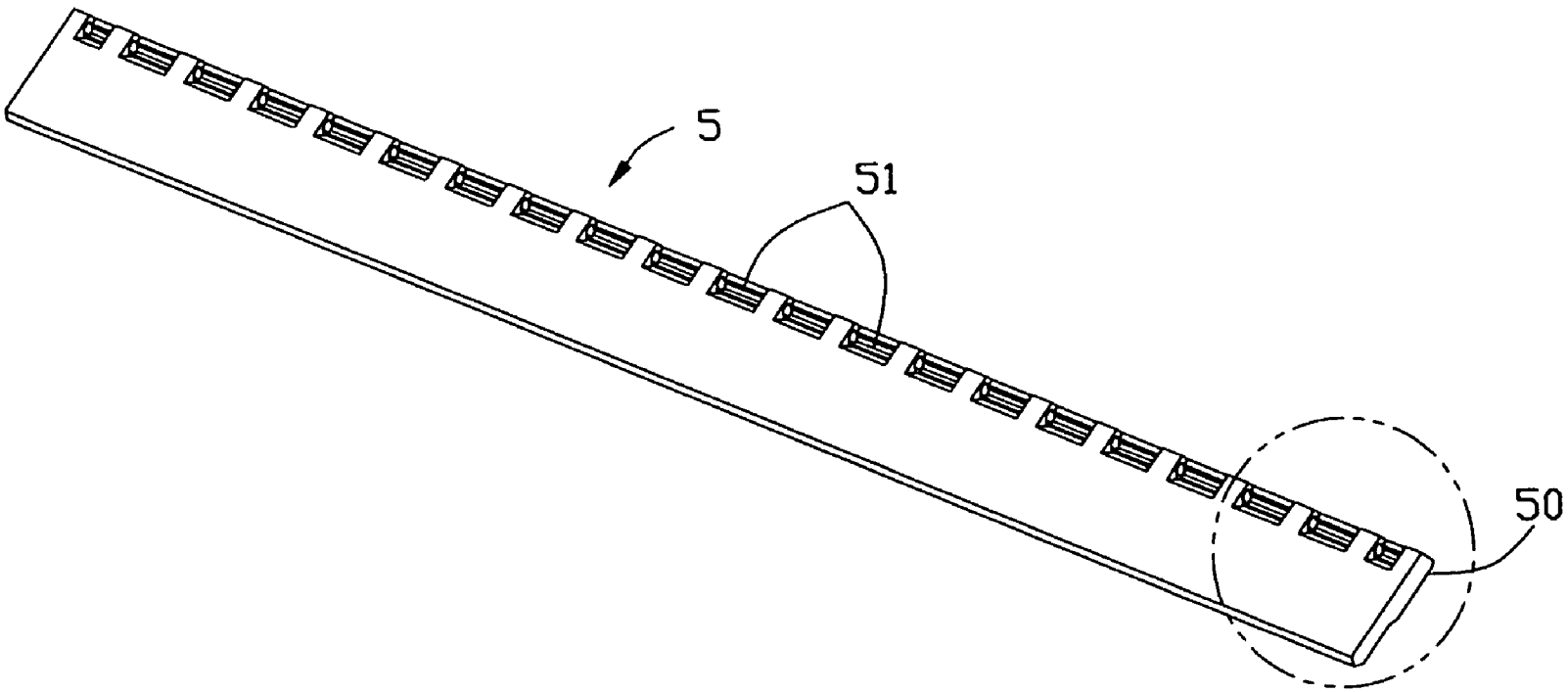
FIG. 4A is a perspective view of the pressing member.
Figure 4B:
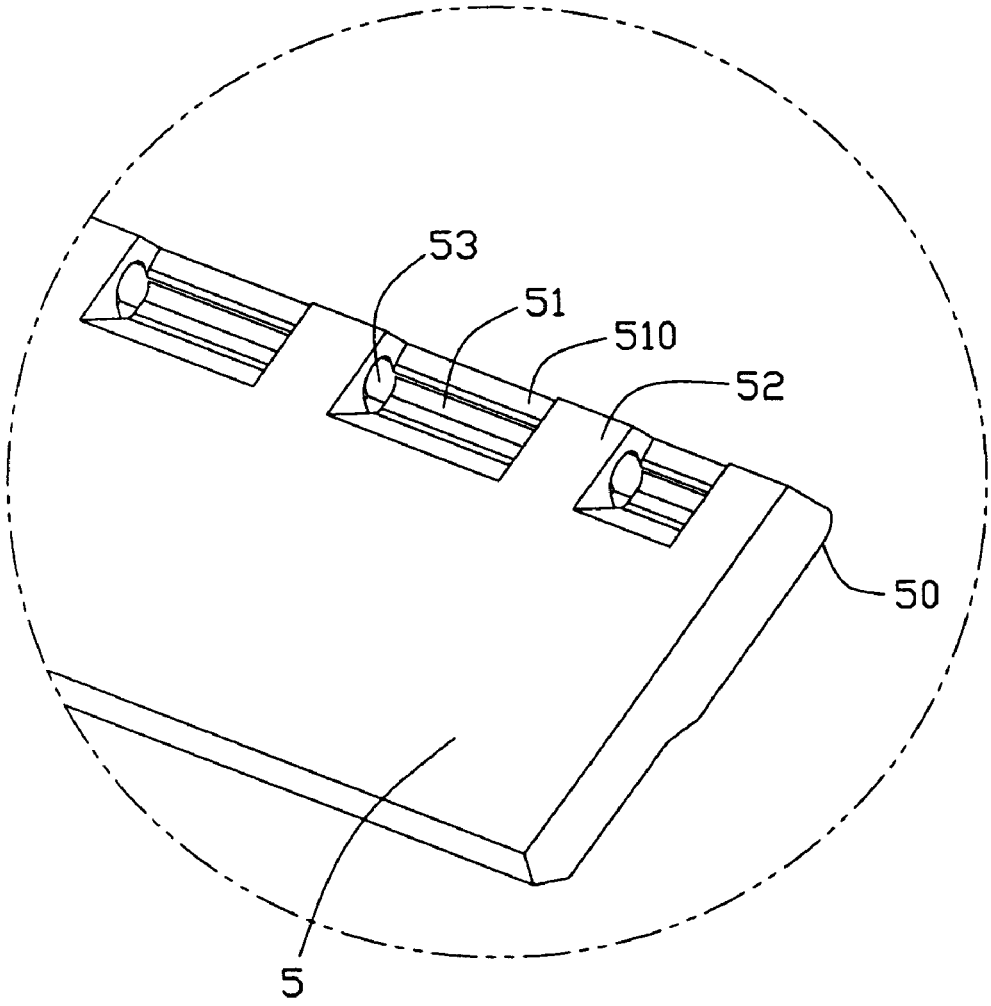
FIG. 4B is an enlarged view of a circled portion in FIG. 4A.

Referring to FIG. 1, a flexible board electrical connector 1 in accordance with the present invention is provided for connecting with a flexible printed circuit (FPC) (not shown). The connector 1 comprises an insulated housing 2, a plurality of first contacts 3 and second contacts 4 retained in the housing 2, a pressing member 5 and a pair of end clips 6 retained in the housing 2 for securing a front of the housing 2 to a printed circuit board (not shown) by soldering.

Figure 5:
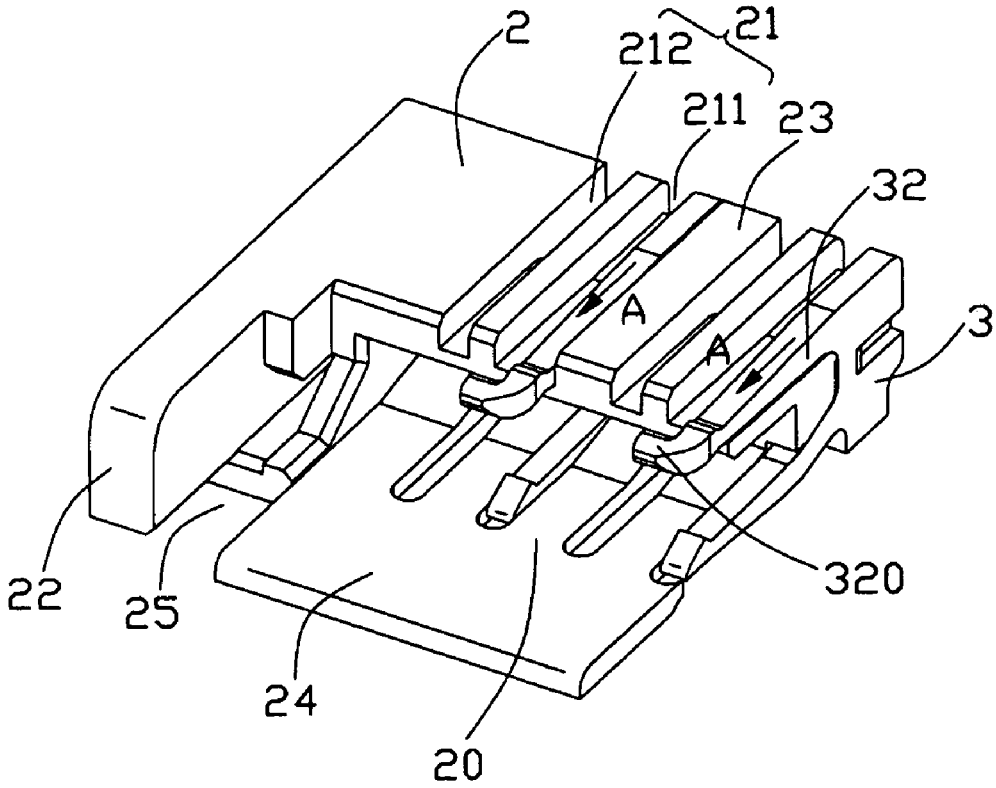
FIG. 5 is a partial, perspective view of partially assembled connector with a plurality of first contacts assembled therein.
Figure 6:
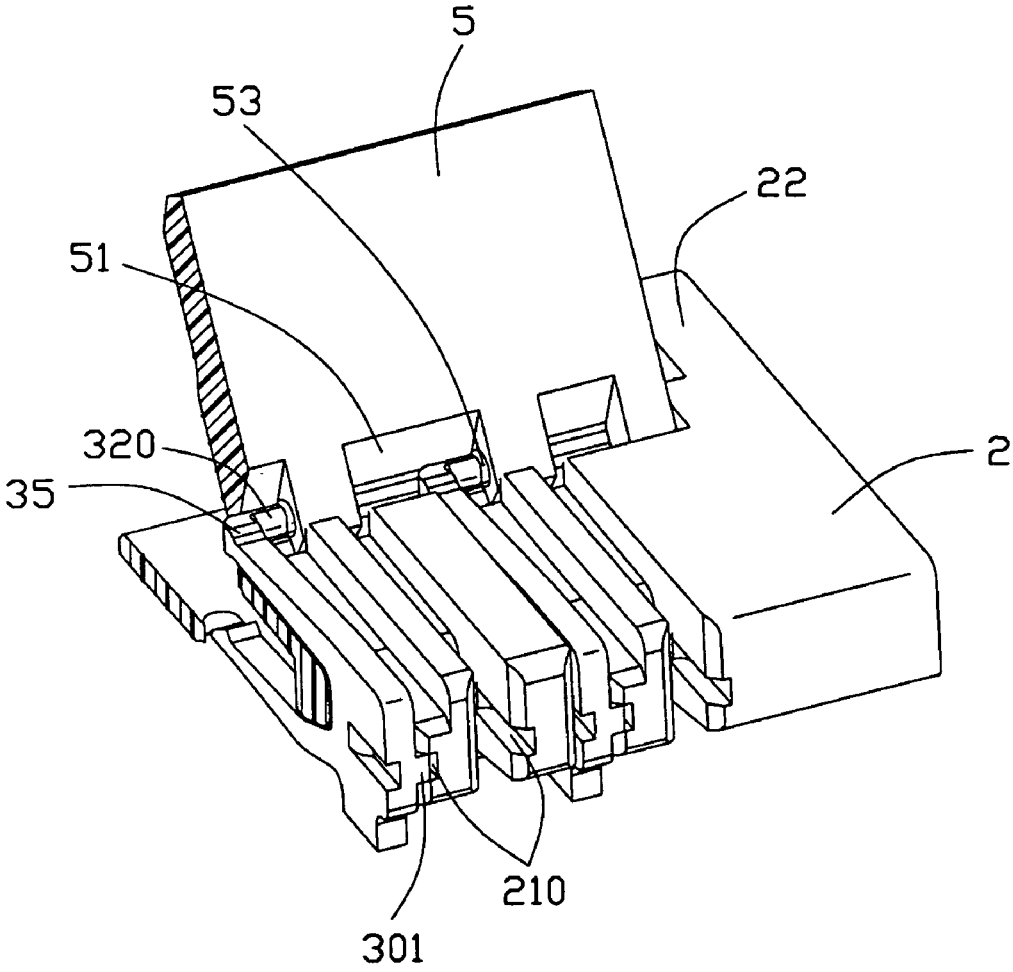
FIG. 6 is a partial, perspective view of partially assembled connector with the pressing member in an original position.
Figure 7:
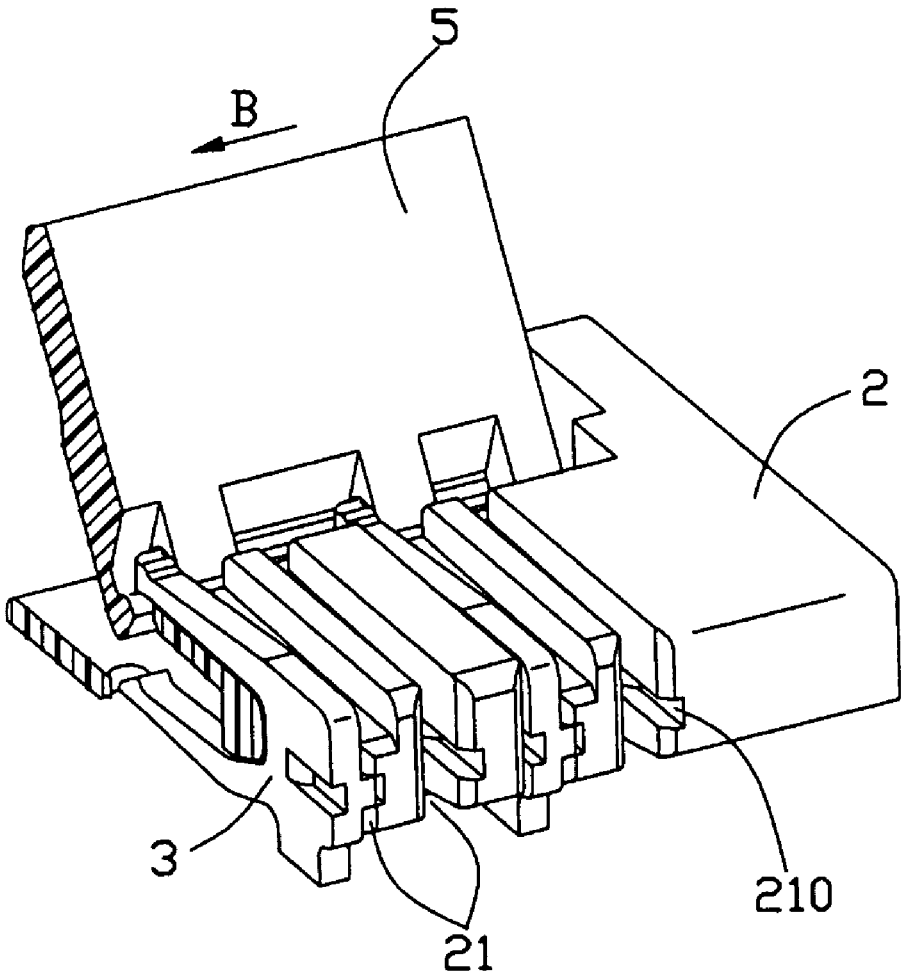
FIG. 7 is a partial, perspective view of partially assembled connector with the pressing member fully assembled therein.
Figure 8:
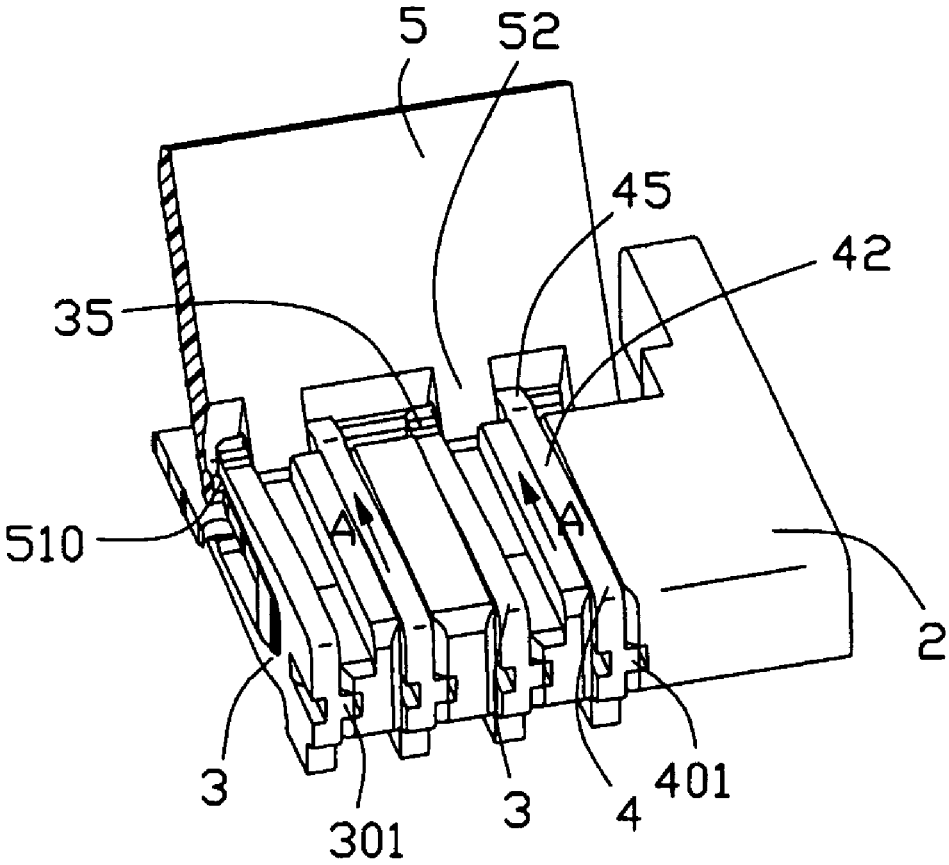
FIG. 8 is a partial, perspective view of partially assembled connector with a plurality of second contacts assembled therein.

Referring to FIGS. 1, 5 and 7, the rectangular housing 2 has an opening 20 extending in a longitudinal direction at an upper front edge, a pair of projecting arms 22 extending forwardly at opposite ends of the opening 20 and a plurality of retaining channels 21 arranged parallel to and between the projecting arms 22 at a predetermined interval for retaining the first contacts 3 and second contacts 4 therein. As clearly shown in the figures, the retaining channels 21 are located at the rear of the housing 2 and are grouped in two styles 211, 212 for respectively retaining the first contacts 3 and the second contacts 4, and each retaining channel 21 extends through an upper wall 23 and a lower wall 24, in this way, the electrical connector 1 has a lower profile. A plurality of guiding slots 210 are recessed from the retaining channels 21 in the longitudinal direction.

Referring to FIGS. 2A, 2B, 3A, 3B, and 5, each of the first contact 3 and second contacts 4 is substantially in a U shape and comprises a connecting portion 30, 40, a support beam 32, 42 having a bearing portion 35, 45, a contact beam 31,41 with a contact portion extending toward the bearing portion 35, 45 and a solder portion 33, 43 extending downwardly from the connecting portion 30, 40. Each first contact 3 further comprises a pivot portion 320 which extends from the bearing portion 35 in the longitudinal direction to produce the pivot point for actuation of the pressing member 5.

Additionally, in FIGS. 2A, 3A, 6, and 8, each first contact 3 and second contact 4 defines a protrusion 301, 401 stamped from the connecting portion 30, 40 and retained in the corresponding guiding slot 210 when the first contacts 3 and the second contacts 4 are assembled onto the housing 2.

Referring to FIGS. 4A, 4B, 6 and 8, the pressing member 5 is an elongated board and comprises a pressing edge 50 extending lengthwise, a plurality of compartments 51 located at opposite sides of the pressing edge 50 and a plurality of partition walls 52 for keeping these compartments 51 apart from each other. Each compartment 51 comprises a bearing wall 510 which is lower than the partition wall 52. Each partition wall 52 defines a passageway 53 extending through a lower surface of the pressing member 5. When the contacts 3, 4 are assembled with the pressing member 5, the bearing portions 35, 45 both abut against solid upper surfaces of the bearing walls 510 and are received in corresponding compartments 51 so that they can simultaneously endure a normal force exerted on the pressing member 5, further, the pivot portions 320 slide into the passageways 53 to function as a pivot point for actuation of the pressing member 5. Thus, during actuation of the pressing member 5 from a first position or an open position (shown in FIGS. 2A, 3A) to a second position or a closed position (shown in FIGS. 2B, 3B), the pivot portions 320 have no chance to come out of the passageway 53, and the first contacts 3 and the second contacts 4 provide equal normal force.

Referring to FIG. 1, the end clips 6 are retained in the spaces formed between the lower wall 24 and projecting arms 22 and each has a retention portion, a folded portion (not labeled) and a solder pad 60 extending below the projecting arm 22 for soldering to the printed circuit board.

The structure of each part of electrical connector 1 and the relationship between these parts have been described clearly above. How the parts are assembled together will be described below.

Referring to FIGS. 5–8 and in conjunction with FIG. 1, firstly, the first contacts 3 are inserted in the retaining channels 211 from the rear of the housing 2 in a direction A perpendicular to the longitudinal direction. The protrusions 301 slide into the guiding slots 210 so that the first contacts 3 cannot move in the longitudinal direction. Secondly, the pressing member 5 is disposed adjacent to the left projecting arm 22 of the housing 2 so as to make the bearing portions 35 of the first contacts 3 be retained in corresponding compartments 51, when the pivot portions 320 just align with the corresponding passageways 53. Thirdly, the pressing member 5 is shifted toward the right projecting arm 22 in the longitudinal direction B until the pivot portions 320 are fully received in the passageways 53, in this way, the first contacts 3 not only serve as pivot points for actuation of the pressing member 5 but also serve as holding section of the pressing member 5. Fourthly, the second contacts 4 are inserted to the retaining channels 212 of the housing 2 in the same direction A as the first contacts 3 and are arranged alternatively with the first contacts 4 in the longitudinal direction, at the same time, the protrusions 401 slide into the guiding slots 210 and the bearing portions 45 are received in corresponding compartment 51. Each partition 52 is confined between the bearing portion 35 of the first contact 3 and the bearing portion 45 of the second contact 4 which are located in adjacent compartments 51 so that the pressing member is accurately secured in the left and right positions, and the pressing member 5 still can pivot freely. Thus, this configuration of the first contacts 3 and the second contacts 4 can effectively prevent the pressing member 5 from shifting in the longitudinal direction. After inserting the FPC in the connector 1, the pressing member 5 can stably pivot from the open position. When the pressing member 5 arrives at the closed position, the pressing edge 50 of the pressing member 5 urges the FPC to tightly contact with the contact portions of the first and second contacts 3, 4. Additionally, the pressing member 5 is very solid and supported evenly by the first and second contacts 3, 4, so the pressing member 5 does not deform appreciably. Lastly, the end clips 6 are assembled into housing 2. The main function of the end clips 6 is to secure the front of the housing 2 by soldering to a printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for connecting a flexible board, comprising:

an insulated housing defining a plurality of retaining channels along a longitudinal direction;

a plurality of first and second contacts retained in the retaining channels, each of the first and second contacts having a contact beam and a support beam with a bearing portion, each first contact further having a pivot portion extending in the longitudinal direction;

a pressing member comprising a plurality of compartments for accommodating said bearing portions and a plurality of partition walls for keeping the compartments apart from each other, each partition wall defining a substantially tubular passageway opening to one longwise end of the housing and arranged to align with the corresponding pivot portion in the longitudinal direction so as to longitudinally receive the corresponding pivot portion therein ; and wherein said partition wall is confined between the bearing portions of the first contact and the second contact.

2. The electrical connector as claimed in claim 1, further comprising at least one end clip assembled in the housing for securing a front of the housing by soldering.

3. The electrical connector as claimed in claim 1, wherein the pivot portions extend from the corresponding bearing portions of the first contacts,

4. The electrical connector as claimed in claim 1, wherein each bearing portion defines a projection extending from an upper surface thereof which secures the pressing member in an open position.

5. The electrical connector as claimed in claim 1, wherein said passageways completely receive the corresponding pivot portions circumferentially, and successively the second contacts are respectively assembled to the housing so as to prevent the pivot portions escaping from the passageways.

6. The electrical connector as claimed in claim 1, wherein each of the first and second contact further comprises a connecting portion joining the contact beam with support beam and defining a protrusion stamped in the longitudinal direction therefrom for retaining in the housing.

7. The electrical connector as claimed in claim 6, wherein the first and second contacts are assembled from rear of the housing.

8. A method of assembling an electrical connector. comprising the steps of:

providing an insulated housing;

assembling a plurality of first contacts to the housing, each of which defining a pivot portion extending in a longitudinal direction;

providing a pressing member defining a plurality of passageways for receiving corresponding pivot portions;

disposing the pressing member closely to one side of the housing to make the passageways align with corresponding pivot portions;

shifting the pressing member to the other side of the housing in the longitudinal direction until the pivot portions are fully received in the passageways; and assembling a plurality of second contacts for securing the pressing member in the longitudinal direction.

9. The method of assembling an electrical connector as claimed in claim 8, further comprising providing a pair of end clips for securing a front of the housing.

10. An electrical connector for use with a flexible printed circuit (FPC), comprising;

an insulative housing;

a plurality of contacts disposed in the housing in a front-to-back direction, each of said contacts including a contact beam for mechanical and electrical connection to the PPC;

a plurality of discrete spaced pivot portions formed on some of said contacts along a longitudinal direction perpendicular to said front-to-back direction: and a pressing member including a plurality of partition walls each defining a receiving hole therein; wherein the receiving holes are arranged to align with the corresponding pivot portions, and finally receive the corresponding pivot portions therein so as to prevent the pressing member from being withdrawn from the housing.

11. The connector as claimed in claim 10, wherein the pressing member is assembled to the housing initially along the front-to-back direction, and successively moved along said longitudinal direction until the pivot portions completely received in the receiving holes, respectively.

12. The connector as claimed in claim 10, wherein said receiving hole completely receives the corresponding pivot portion circumferentially.

13. The connector as claimed in claim 10, wherein a compartment is formed between every adjacent two partition walls to receive the contact beam of the corresponding contact therein.

14. The connector as claimed in claim 10, wherein said some of said contacts with said pivot portions are alternately arranged with some of said contacts without said pivot portions along said longitudinal direction.

15. The connector as claimed in claim 14, wherein some of said contacts are assembled to the housing only after the pressing member has been assembled to the housing.

* * * * *